US009771935B2

(12) United States Patent
Arnold et al.

(10) Patent No.: US 9,771,935 B2
(45) Date of Patent: Sep. 26, 2017

(54) VARIABLE DISPLACEMENT VANE PUMP WITH THERMO-COMPENSATION

(71) Applicant: Stackpole Powertrain International ULC, Mississauga, Ontario (CA)

(72) Inventors: Manfred Arnold, Aachen (DE); Hans Peter Kutzer, Gangelt (DE); Ralph Valkenberg, Stolberg (DE)

(73) Assignee: Stackpole International Engineered Products, Ltd., Mississauga, Ontario (CA)

( * ) Notice: Subject to any disclaimer, the term of this patent is extended or adjusted under 35 U.S.C. 154(b) by 366 days.

(21) Appl. No.: 14/477,620

(22) Filed: Sep. 4, 2014

(65) Prior Publication Data

US 2016/0069346 A1 Mar. 10, 2016

(51) Int. Cl.
*F01C 20/18* (2006.01)
*F01M 1/16* (2006.01)
(Continued)

(52) U.S. Cl.
CPC ..... *F04C 14/22* (2013.01); *F01M 1/16* (2013.01); *F04C 2/3442* (2013.01);
(Continued)

(58) Field of Classification Search
CPC .... F04C 14/22; F04C 2270/19; F04C 2/3442; F01M 2001/0238; F01M 2001/0246
(Continued)

(56) References Cited

U.S. PATENT DOCUMENTS 4,510,962 A * 4/1985 Mott ..... F04C 14/226 137/102
4,678,412 A * 7/1987 Dantlgraber ..... F04C 14/226 417/220

(Continued)

FOREIGN PATENT DOCUMENTS

DE 102009039776 A1 3/2011
DE 10201201683 A1 5/2014

(Continued)

OTHER PUBLICATIONS

International Search Report and Written Opinion dated Nov. 26, 2015 for Appln. No. PCT/IB2015/056723.

(Continued)

*Primary Examiner* — Mark Laurenzi
*Assistant Examiner* — Anthony Ayala Delgado
(74) *Attorney, Agent, or Firm* — Pillsbury Winthrop Shaw Pittman LLP

(57) ABSTRACT

A variable displacement vane pump has a control slide displaceable within its housing and a first control chamber and a second control chamber for receiving pressurized lubricant. A thermally adjustable control valve is provided in the housing for adjusting pump displacement based on a temperature of the lubricant. In addition to fluid communication channels in the control chambers, at least one vent port is provided in the second chamber. The control valve is configured to control pressure and fluid communication between the chambers along with the control slide. The control valve can help reduce pump displacement at lower temperatures and low engine speeds. At lower temperatures, the second control chamber can be pressurized by the first control chamber. At higher temperatures, the second control chamber can be vented through the control valve and/or the vent port, despite the position of the control slide.

24 Claims, 8 Drawing Sheets

(51) Int. Cl.
*F01M 1/02* (2006.01)
*F04C 2/344* (2006.01)
*F04C 14/22* (2006.01)

(52) U.S. Cl.
CPC ... *F04C 14/226* (2013.01); *F01M 2001/0238* (2013.01); *F01M 2001/0246* (2013.01); *F04C 2270/19* (2013.01)

(58) Field of Classification Search
USPC ..... 418/27, 84
See application file for complete search history.

(56) References Cited

U.S. PATENT DOCUMENTS

| | | | |
|---|---|---|---|
| 6,120,256 | A | 9/2000 | Miyazawa |
| 6,217,296 | B1 | 4/2001 | Miyazawa et al. |
| 6,309,193 | B1 | 10/2001 | Repple et al. |
| 6,481,458 | B2 | 11/2002 | Hirano et al. |
| 6,499,963 | B2 | 12/2002 | Repple et al. |
| 7,794,217 | B2 | 9/2010 | Williamson et al. |
| 8,047,822 | B2 | 11/2011 | Shulver et al. |
| 8,057,201 | B2 | 11/2011 | Shulver et al. |
| 8,202,061 | B2 | 6/2012 | Shulver et al. |
| 8,444,395 | B2 | 5/2013 | Tanasuca et al. |
| 8,602,748 | B2 | 12/2013 | Armenio et al. |
| 8,684,702 | B2 | 4/2014 | Watanabe et al. |
| 8,720,849 | B2 | 5/2014 | Williamson |
| 9,534,519 | B2 * | 1/2017 | Valkenberg ..... F04C 2/344 |
| 2008/0069704 | A1 | 3/2008 | Armenio et al. |
| 2010/0226799 | A1 | 9/2010 | Watanabe et al. |
| 2012/0183426 | A1 | 7/2012 | Maffeis |
| 2013/0136641 | A1 | 5/2013 | Novi et al. |
| 2013/0164162 | A1 * | 6/2013 | Saga ..... F04C 14/226 418/24 |
| 2014/0072456 | A1 * | 3/2014 | Watanabe ..... F04B 17/003 417/218 |
| 2014/0182541 | A1 | 7/2014 | Yi |
| 2016/0186752 | A1 * | 6/2016 | Valkenberg ..... F04C 2/3441 418/28 |

FOREIGN PATENT DOCUMENTS

| | | | |
|---|---|---|---|
| DE | 102013114268 | A1 | 7/2014 |
| EP | 0 049 838 | A1 | 4/1982 |
| EP | 2264318 | A1 | 12/2010 |
| JP | 2008-025423 | | 2/2008 |
| WO | WO 2012/013232 | | 2/2012 |

OTHER PUBLICATIONS

International Preliminary Report of Patentability dated Mar. 16, 2017 in International Application PCT/IB2015/056723.
Extended European Search Report dated Apr. 24, 2017 in European APplication 15838091.5.

* cited by examiner

VARIABLE DISPLACEMENT VANE PUMP WITH THERMO-COMPENSATION

BACKGROUND

Field

The present disclosure is generally related to a variable displacement vane pump for providing pressurized lubricant to a system. More specifically, this disclosure relates to using pressure and temperature in a variable displacement vane pump to control pump displacement and pressure levels within two control chambers.

Description of Related Art

Vane pumps are known for use for pumping fluids or lubricants, such as oil, to internal combustion engines. Some known systems may utilize a single control chamber for moving lubricant. U.S. Patent Application Nos. 2008/0069704, 2012/0183426, and 2013/0136641 illustrate examples of passively controlled variable vane pump having one control chamber, each of which is hereby incorporated in their entirety. Other types of pumps are disclosed in U.S. Pat. Nos. 8,047,822, 8,057,201, and 8,444,395, which are also incorporated herein in their entirety.

SUMMARY

It is an aspect of this disclosure to provide a variable displacement vane pump for dispensing lubricant to a system. The pump includes: a housing; an inlet for inputting lubricant from a source into the housing; an outlet for delivering pressurized lubricant to the system from the housing; a control slide displaceable within the housing between a first slide position and a second slide position to adjust displacement of the pump through the outlet; a resilient structure biasing the control slide in the first slide position; a rotor with at least one vane mounted in the housing and configured for rotation within and relative to the control slide, the at least one vane configured for engagement with an inside surface of the control slide during rotation thereof; a first control chamber between the housing and the control slide and a second control chamber between the housing and the control slide for receiving pressurized lubricant; a thermally adjustable control valve, the thermally adjustable control valve configured for movement between a first valve position and a second valve position based on a temperature of the lubricant, the thermally adjustable control valve being in the first valve position for a temperature that is below a predetermined temperature and in the second valve position for a temperature that is at or above the predetermined temperature; a first port connected to the first control chamber and a second port connected to the second control chamber, the first and second ports configured for selective fluid communication to form a control pressure channel extending between the first control chamber and the second control chamber; a third port in the valve configured for selective fluid communication with the second port to form a vent channel between the second control chamber and the thermally adjustable control valve; and a vent port provided in the housing and configured for selective fluid communication with the second control chamber. In its first valve position, the thermally adjustable control valve is configured to control pressure in the second control chamber via fluid communication of the first port and the second port for delivery of pressurized lubricant through the control pressure channel into the second control chamber, thereby pressurizing the second control chamber. In its second valve position, the thermally adjustable control valve is configured to control pressure in the second control chamber via venting pressurized lubricant from the second control chamber via the vent channel by communicating the second port to the third port or via the vent port. The position of the control slide within the housing is further configured to aid in selectively controlling the venting of the pressurized lubricant through the vent channel or through the vent port during venting of the second control chamber Another aspect provides a system that includes: an engine; a lubricant source containing lubricant and a variable displacement vane pump connected to the lubricant source for dispensing lubricant to the engine. The pump includes: a housing; an inlet for inputting lubricant from a source into the housing; an outlet for delivering pressurized lubricant to the system from the housing; a control slide displaceable within the housing between a first slide position and a second slide position to adjust displacement of the pump through the outlet; a resilient structure biasing the control slide in the first slide position; a rotor with at least one vane mounted in the housing and configured for rotation within and relative to the control slide, the at least one vane configured for engagement with an inside surface of the control slide during rotation thereof; a first control chamber between the housing and the control slide and a second control chamber between the housing and the control slide for receiving pressurized lubricant; a thermally adjustable control valve, the thermally adjustable control valve configured for movement between a first valve position and a second valve position based on a temperature of the lubricant, the thermally adjustable control valve being in the first valve position for a temperature that is below a predetermined temperature and in the second valve position for a temperature that is at or above the predetermined temperature; a first port connected to the first control chamber and a second port connected to the second control chamber, the first and second ports configured for selective fluid communication to form a control pressure channel extending between the first control chamber and the second control chamber; a third port in the valve configured for selective fluid communication with the second port to form a vent channel between the second control chamber and the thermally adjustable control valve; and a vent port provided in the housing and configured for selective fluid communication with the second control chamber. In its first valve position, the thermally adjustable control valve is configured to control pressure in the second control chamber via fluid communication of the first port and the second port for delivery of pressurized lubricant through the control pressure channel into the second control chamber, thereby pressurizing the second control chamber. In its second valve position, the thermally adjustable control valve is configured to control pressure in the second control chamber via venting pressurized lubricant from the second control chamber via the vent channel by communicating the second port to the third port or via the vent port. The position of the control slide within the housing is further configured to aid in selectively controlling the venting of the pressurized lubricant through the vent channel or through the vent port during venting of the second control chamber.

Other aspects and advantages of the present invention will become apparent from the following detailed description, the accompanying drawings, and the appended claims.

DETAILED DESCRIPTION OF THE PREFERRED EMBODIMENT(S)

As detailed herein, a variable displacement vane pump has a control slide displaceable within its housing, and a first control chamber and a second control chamber each between the housing and the control slide for receiving pressurized lubricant. A thermally adjustable control valve is provided in the housing for adjusting pump displacement based on a temperature of the lubricant. In addition to fluid communication channels in the control chambers, a vent port is provided in the housing, e.g., associated with or in the second chamber. The thermally adjustable control valve is configured to control pressure and fluid communication between the chambers, channels, and vent port. The control valve can thus reduce the pump displacement at lower temperatures. At higher temperatures, the second control chamber can be vented through the thermally adjustable control valve and/or the vent port, depending on the position of the control slide, e.g., depending on the pressure levels or the pump displacement.

As understood by one of ordinary skill in the art, "pump displacement" or "displacement" as used throughout this disclosure refers to a volume of liquid (lubricant) a pump is capable of moving during a specified period of time, i.e., a flow rate.

Figure 1:
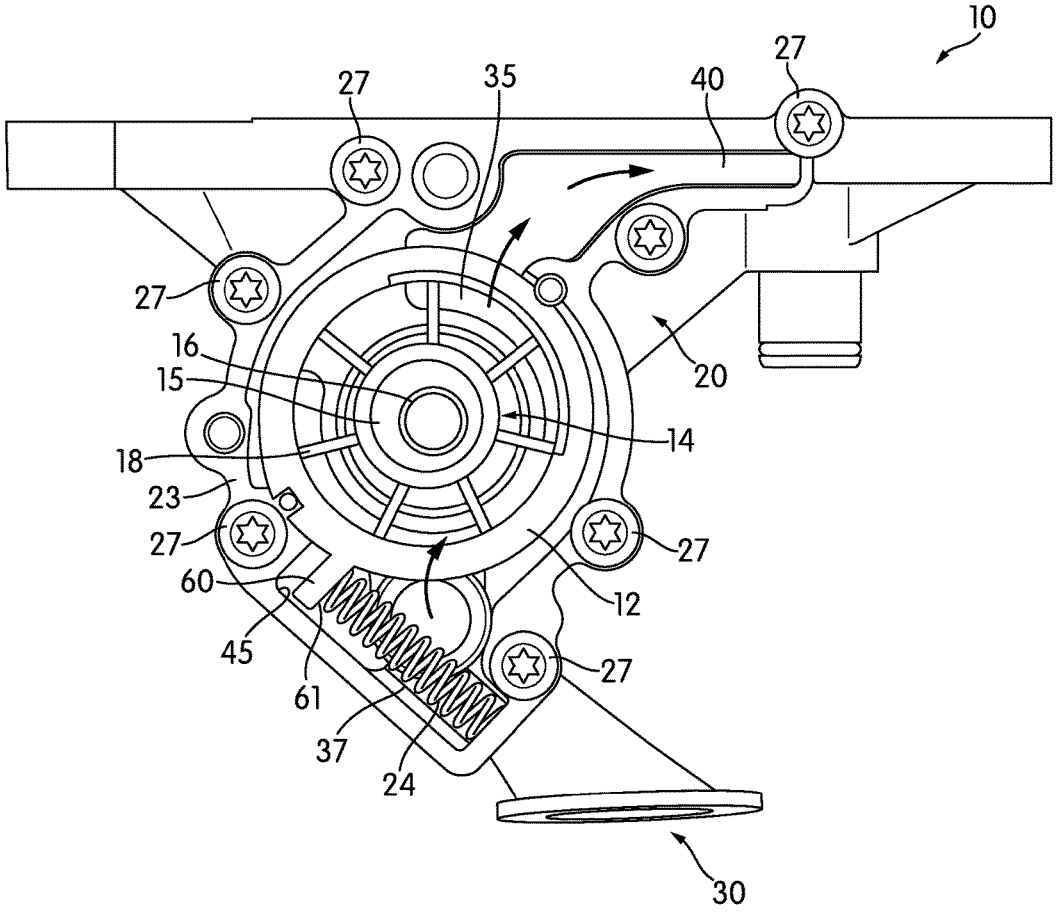
FIG. 1 is a perspective view of a pump in accordance with an embodiment of the present disclosure.

FIG. 1 is a perspective view of a pump 10 in accordance with an embodiment of the present disclosure. The pump 10 is a variable vane pump with a multi-chamber design. Pump 10 has a housing 20 with an inlet 30 and an outlet 40. The inlet 30 receives fluid or inputs lubricant to be pumped (typically oil in the automotive context) from a source 26 (see FIG. 4) into the housing 20, and the outlet 40 is used for discharging or delivering the pressurized fluid or lubricant to the system, e.g., engine. A control slide 12 (explained in greater detail below), a rotor 14, a shaft 16, and resilient structure 24 are provided in housing 20, as is known in the art. The inlet and outlet 30, 40 are disposed on opposing radial sides of the rotational axis of the rotor 14. As represented by the views in FIG. 11 and FIG. 14, the housing 20 has at least one inlet port 31 for intaking fluid to be pumped, and at least one outlet port 33 for discharging the fluid. The inlet port 31 and outlet port 33 each may have a crescent shape, and may be formed through the same wall located on one axial side or both axial sides of the housing (with regard to the rotational axis of the rotor 16). The inlet and outlet ports 31, 33 are disposed on opposing radial sides of the rotational axis of the rotor 16. These structures are conventional, and need not be described in detail. The shape of the inlet 30 and/or outlet 40 is not intended to be limiting. Other configurations may be used, such as differently shaped or numbered ports, etc. Further, it should be understood that more than one inlet or outlet may be provided (e.g., via multiple ports).

Figure 5:
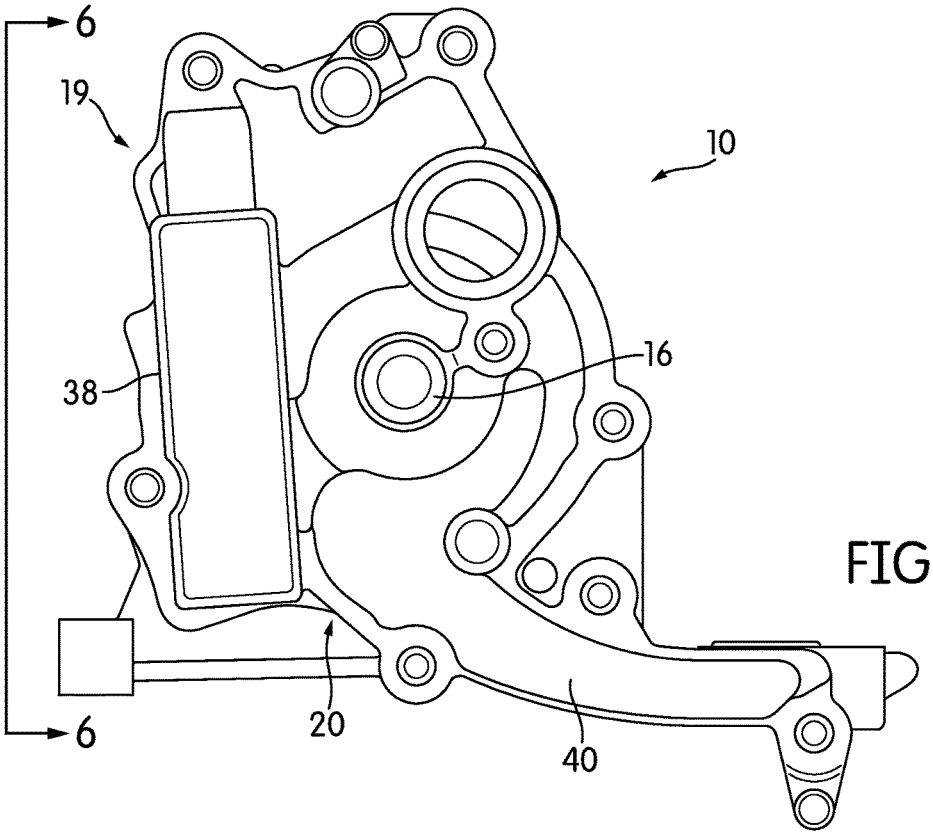
FIG. 5 is a top view of a pump for use in the system of FIG. 4, in accordance with an embodiment.
Figure 7:
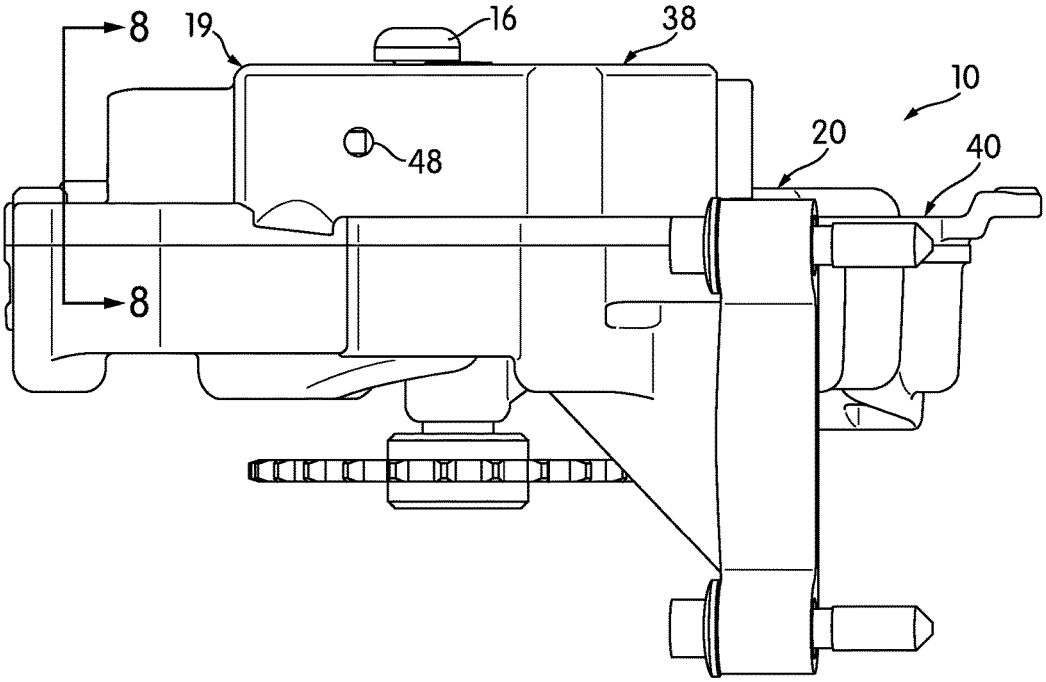
FIG. 7 is a side view of the pump, in accordance with an embodiment.

The housing 20 may be made of any material, and may be formed by aluminum die cast, powdered metal forming, forging, or any other desired manufacturing technique. The housing 20 encloses internal chambers, also referred to herein as first control chamber 34 and second control chamber 36. In the drawings, the main shell of the housing 20 is shown. Walls define axial sides of the internal chambers and a peripheral wall 23 extends around to surround the internal chambers peripherally. A cover 19 (e.g., shown in FIG. 5 and FIG. 7) attaches to the housing 20, such as by fasteners 27 inserted into various fastener bores 29 (e.g., see FIG. 9) provided along the peripheral wall 23. The cover is not shown in FIG. 1, for example, so that some of the internal components of the pump can be seen. However, use of such cover 19 is generally well known and need not be described in greater detail herethroughout. The cover 19 may be made of any material, and may be formed by aluminum die cast, powdered metal forming, forging, or any other desired manufacturing technique. The drawings also show parts of and an underside of the cover 19, which helps enclose the internal chambers of the pump 10 along with the housing 20. A gasket or other seal(s) may optionally be provided between the cover 19 and peripheral wall 23 of the housing 20 to seal the internal chambers.

The housing 20 and cover 19 includes various surfaces for accommodating movement and sealing engagement of the control slide 12, which will be described in further detail below.

Figure 9:
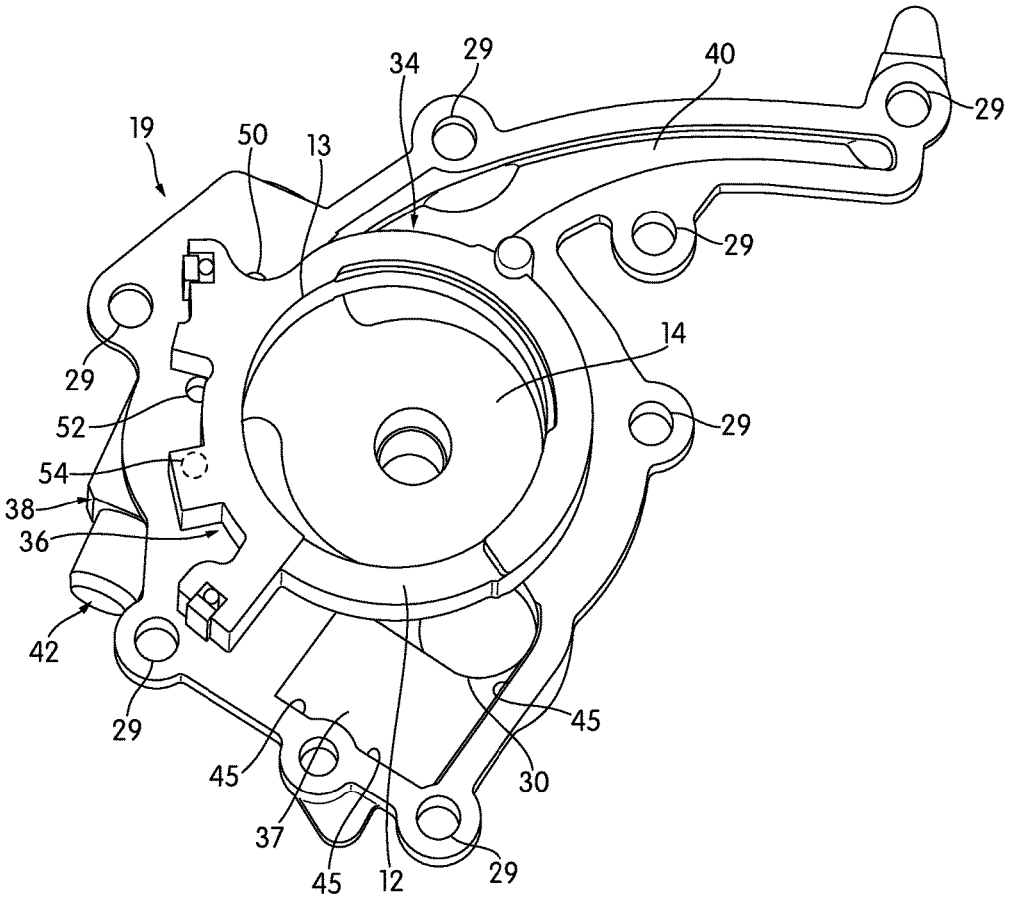
FIG. 9 is an underside perspective view of the cover of pump housing and some of its parts in a first slide position.
Figure 11:
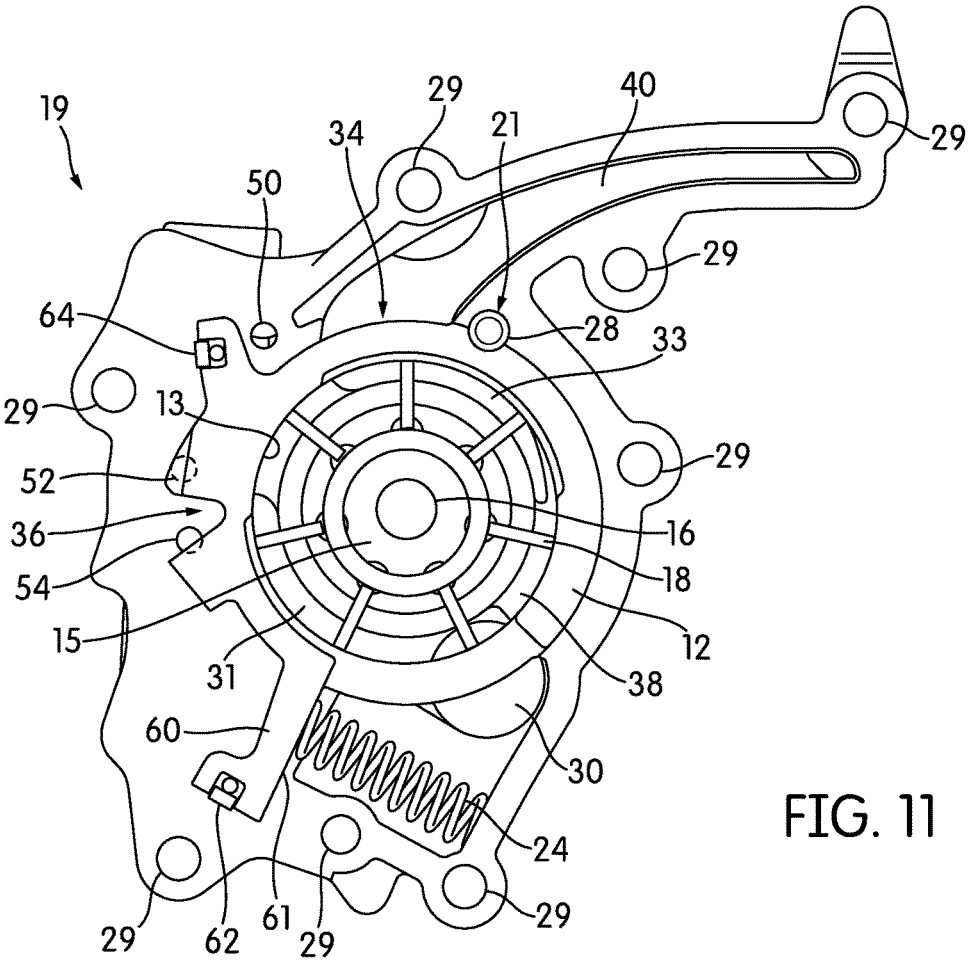
FIG. 11 is an underside view of the cover of the pump housing and some of its parts in a second slide position.
Figure 14:
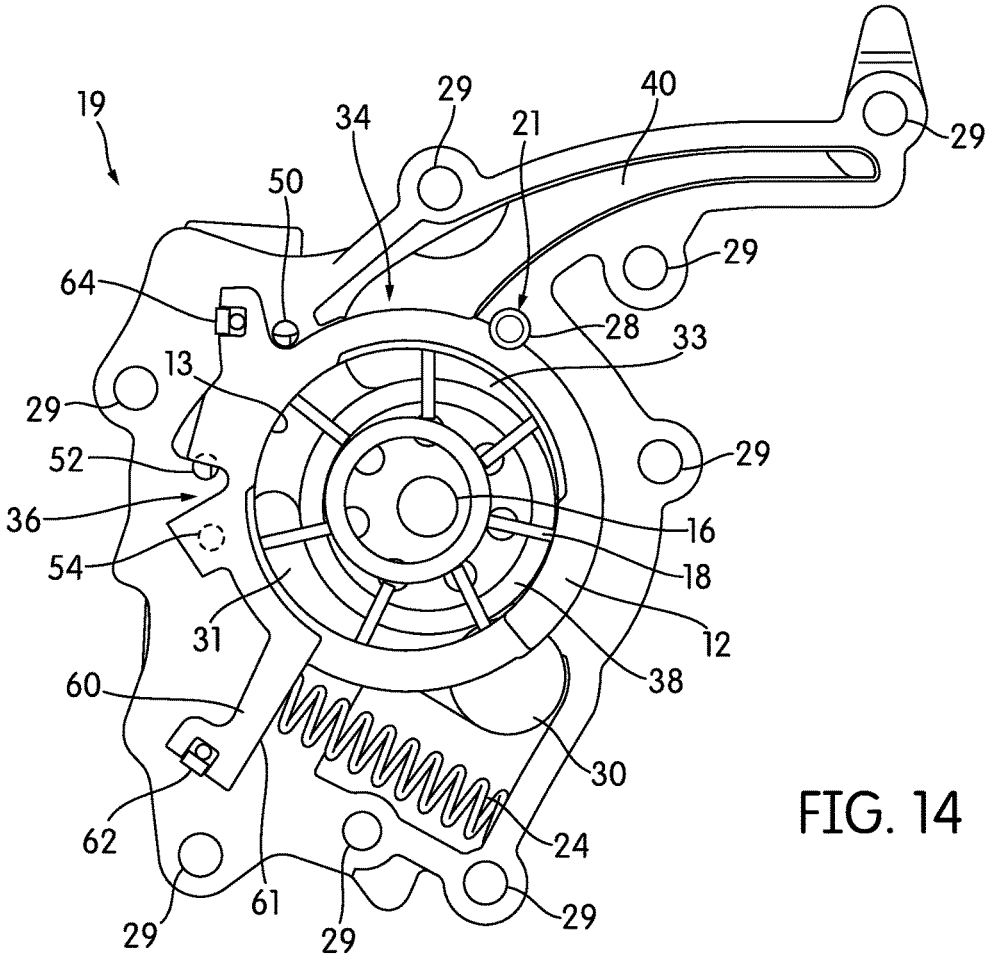
FIG. 14 is an underside view of the cover of the pump housing and some of its parts with the slide in a position close to the first slide position.

The control slide 12 is displaceable within the housing 20 and relative to the cover 19 between a first slide position and a second slide position to adjust displacement of the pump 10 through the outlet 40. In accordance with an embodiment, the control slide 12 is pivotally mounted and configured for pivotal displacement within the housing 20 between the first and second slide positions. The first slide position is defined as a home position for maximum displacement. FIG. 9 shows an example of the slide in the first or maximum displacement slide position. FIG. 14 illustrates an example of the slide in a position close to the first or maximum displacement slide position. The second slide position is defined as a position away from the first slide position or position for maximum displacement, e.g., a reduced displacement position. More specifically, it can include any number of positions that is away from the first slide position, and may, in one embodiment, include when the slide is close to a minimum displacement position, or may be the minimum displacement position. For example, the control slide 12 can be pivotally mounted relative to the first and second internal control chambers 34 and 36. When the control slide 12 pivots away from the first slide position, the control slide 12 can be considered to be in a second slide position, despite the angle of pivoting. FIG. 11 shows an example of the slide in a second or a reduced displacement slide position.

Specifically, in an embodiment wherein the control slide 12 pivots, a pivot pin 28 or similar feature may be provided to control the pivoting action of the control slide 12. The pivot pin 28 can be mounted to the housing 20. The configuration of the pivotal connection of the control slide 12 in the housing 20 should not be limited.

The control slide 12 has an inside or inner surface 13 (e.g., see FIG. 9) defining a rotor receiving space 35. The rotor receiving space 35 has a generally circular configuration. This rotor receiving space 35 communicates directly with the inlet and outlet 30, 40 for drawing in oil, lubricant, or another fluid under negative intake pressure through the inlet 30, and expelling the same under positive discharge pressure out the outlet 40.

The rotor 14 is rotatably mounted in the housing 20 within the rotor receiving space 35 of the control slide 12. The rotor 14 is configured for rotation within and relative to the control slide 12. The rotor 14 has a central axis that is typically eccentric to a central axis of the control slide 12 (and/or rotor receiving space 35). The rotor 14 is connected to a drive input in a conventional manner, such as a drive pulley, drive shaft, engine crank, or gear. As shown in FIG. 1, the rotor 14 is connected to the shaft 16.

The rotor 14 has at least one radially extending vane 18 mounted to the rotor 14 for radial movement. Specifically, each vane 18 is mounted at a proximal end in a radial slot in the central ring or hub 15 of the rotor 14 in a manner that allows them to slide radially. Centrifugal force may force the vane(s) 18 radially outwardly to engage and/or maintain engagement between distal end(s) of the vane(s) and the inside or inner surface 13 of the control slide 12 during rotation thereof. This type of mounting is conventional and well known. Other variations may be used, such as springs or other resilient structures in the slots for biasing the vanes radially outwardly, and this example is not limiting. Thus, the vane(s) 18 can be sealingly engaged with the inner surface 13 of the control slide 12 such that rotating the rotor 14 draws fluid in through the inlet 30 by negative intake pressure and outputs the fluid out through the outlet 40 by positive discharge pressure. Because of the eccentric relationship between the control slide 12 and the rotor 14, a high pressure volume of the fluid is created on the side where the outlet 40 is located, and a low pressure volume of the fluid is created on the side where the inlet 30 is located (which in the art are referred to as the high pressure and low pressure sides of the pump). Hence, this causes the intake of the fluid through the inlet 30 and the discharge of the fluid through the outlet 40. This functionality of the pump is well known, and need not be detailed further.

The control slide 12 can be moved (e.g., pivoted) to alter the position and motion of rotor 14 and its vane(s) relative to the inner surface 13 of the slide 12, and, thus, alter the displacement of the pump and distribution of lubricant through the outlet 40. The resilient structure 24 biases or urges the control slide 12 in its first slide position (or first pivotal direction or position, or a maximum displacement position). A pressure change in the housing 20 can result in the control slide 12 moving or pivoting (e.g., centering) relative to the rotor 14, adjusting (e.g., reducing or increasing) displacement of the pump. The first slide position is the position or direction that increases the eccentricity between the control slide 12 and rotor axes. As the eccentricity increases, the flow rate or displacement of the pump increases. Conversely, as the eccentricity decreases, the flow rate or displacement of the pump also drops. In some embodiments, there may be a position where the eccentricity is zero, meaning the rotor and ring axes are coaxial. In this position, the flow is zero, or very close to zero, because the high and low pressure sides have the same relative volumes. Accordingly, in an embodiment, the first slide position of the control slide 12 is the position or direction for maximum offset or displacement of the pump 10 (e.g., see FIG. 9), while the second slide position of the control slide 12 is the position or direction for reduced, limited, or minimal offset or displacement (e.g., see FIG. 11). Again, this functionality of a vane pump is well known, and need not be described in further detail.

In the illustrated embodiment, the resilient structure 24 is a spring, such as a coil spring. In accordance with an embodiment, the resilient structure 24 is a spring for biasing and/or returning the control slide 12 to its default or biased position (first or home slide position for minimum eccentricity with the rotor 14). The control slide 12 can be moved against the spring or resilient structure to decrease eccentricity with the rotor 14 based on the pressure within the housing 20 to adjust displacement and hence output flow. The housing 12 may include a receiving portion 37 for the resilient structure 24, defined by portions of the peripheral wall 23, for example, to locate and support the structure (or spring). The receiving portion 37 may include one or more side walls 45 to restrain the structure 24 against lateral deflection or buckling, and a bearing surface against which one end of the spring is engaged. The control slide 12 includes a radially extending bearing structure 60 defining a bearing surface 61 against which the resilient structure 24 is engaged, for example. Other constructions or configurations may be used.

A plurality of seals such as seals 62, 64, such as shown in FIG. 11, may be provided between the housing 20/cover 19 and the control slide 12, for example.

As detailed above, pressure is used to control the distribution or delivery of lubricant by the pump 10. The control pressure can be, for example, the pump outlet pressure or the engine gallery feedback pressure. The control pressure may be used to control parts of the pump so that the desired amount of pressurized lubricant is delivered to the system, e.g., engine. Generally, however, at lower temperatures (e.g., 20° C.), a pump may reaches a control pressure level at low speed, so adjustment or control of the pump displacement is typically active. The pressure level at low speed is generally higher than needed for adequate engine performance when the control mechanism of the pump starts at low speed. At higher temperatures (e.g., 60° C. or above), the pressure level may increases up to a control pressure, then the displacement and pressure is reduced.

As disclosed herein, in addition to the control pressure, a temperature of the lubricant, e.g., via a temperature determined by a thermally reactive device, is used to control a thermally adjustable control valve for directing the pressurized lubricant in the housing and varying displacement of the variable vane pump to the engine.

Figure 2:
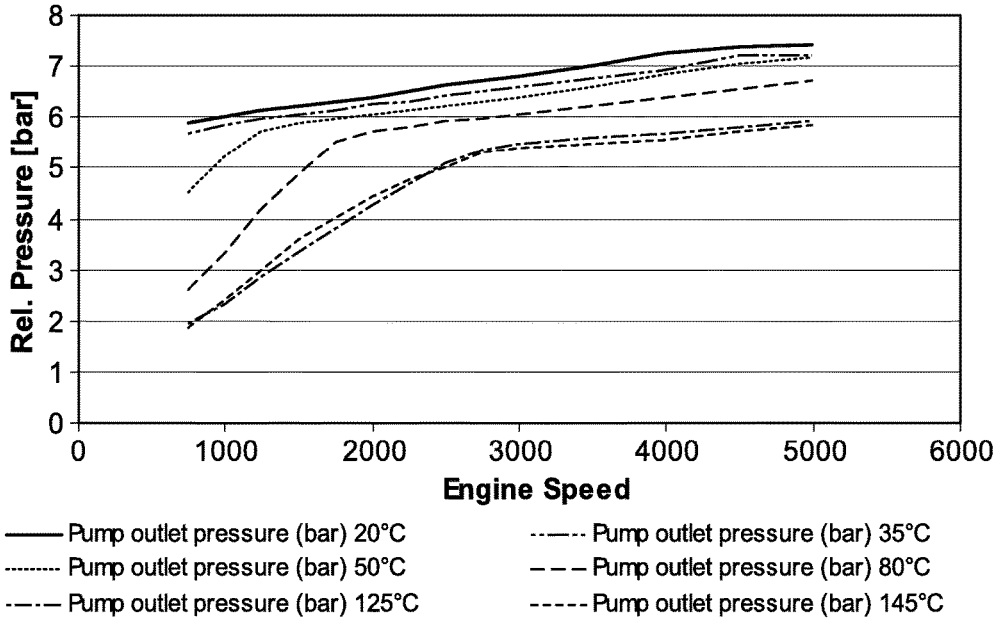
FIG. 2 is an exemplary plot of relative pressure versus engine speed in a pump at various temperatures, without use of a thermally reactive device.
Figure 3:
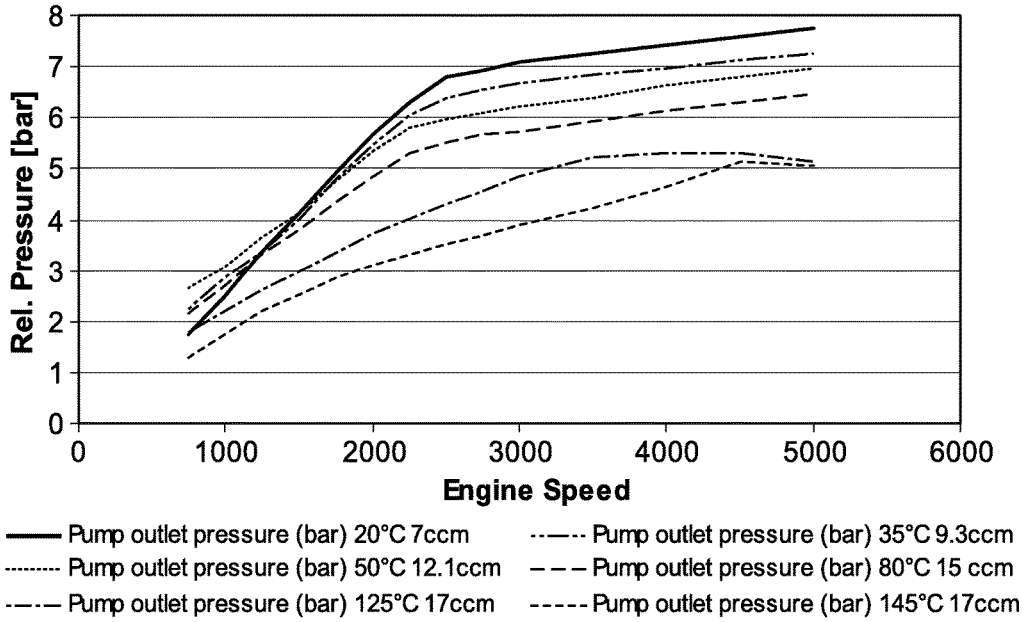
FIG. 3 is an exemplary plot of relative pressure versus engine speed in a pump at various temperatures with use of a thermally reactive device.

FIG. 2 is an exemplary plot of relative pressure versus engine speed in a pump at various temperatures, without use of a thermally adjustable/reactive device. As seen in the plot of FIG. 2, at lower engine speeds, e.g., less than 3000 rpm, and lower temperatures, e.g., less than 50 degrees Celsius, the pump outlet pressure is relatively high or increased. Such high pressure levels and displacement of lubricant from the pump is not necessary at lower engine speeds or for adequate engine performance. Accordingly, this disclosure uses a thermally adjustable control valve 44 in the pump 10 to reduce the pump displacement at lower temperatures. The control valve 44 can thus directly reduce the pump displacement when lubricant is running through the pump 10 at lower temperatures. In some cases, because the temperature of the lubricant may tend to be lower when the engine is running at lower speeds, the control valve 44 may indirectly be influenced by both low temperature and low engine speed. The displacement may reduce high pressure levels at low engine speeds that are not needed for the engine performance. FIG. 3 is an exemplary plot of relative pressure versus engine speed in a pump at various temperatures with use of a thermally adjustable control valve. As seen in the plot of FIG. 3, particularly when compared to the plot of FIG. 2, the pump outlet pressure is relatively reduced at lower engine speeds, e.g., less than 3000 rpm. The slide 12 may be used to open a vent at a defined slide position to limit the pump displacement and avoid a lower pressure level(s) at higher engine speeds. Additional features and advantages of this disclosure are explained further below.

Figure 4:
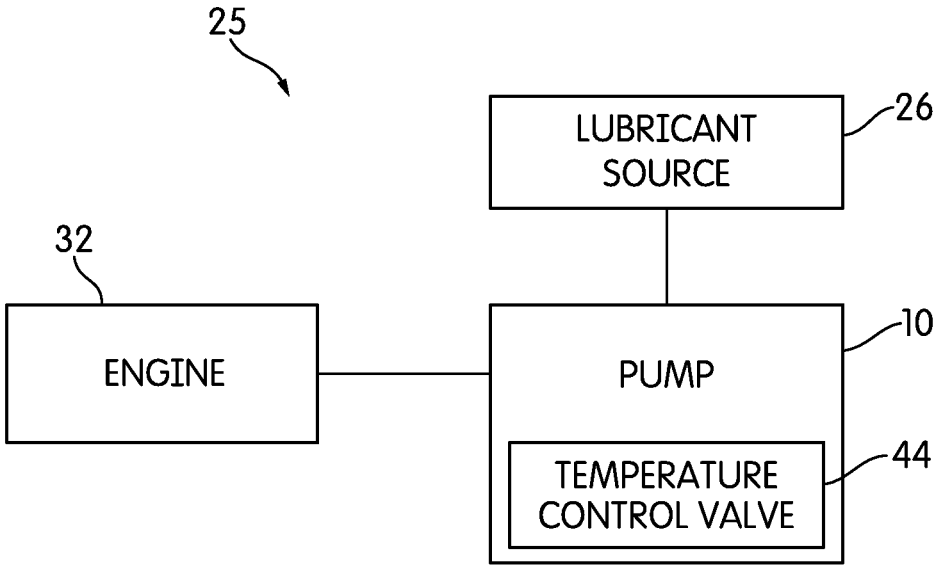
FIG. 4 is a schematic diagram of a system in accordance with an embodiment of the present disclosure.

FIG. 4 is a schematic diagram of a system 25 in accordance with an embodiment of the present disclosure. The system 25 can be a vehicle or part of a vehicle, for example. The system 25 includes a mechanical system such as an engine 32 (e.g., internal combustion engine) for receiving pressurized lubricant from the pump 10. The pump 10 receives lubricant (e.g., oil) from a lubricant source 26 (input via inlet 30) and pressurizes and delivers it to the engine 32 (output via outlet 40).

Referring now to FIG. 9, FIG. 11, and FIG. 14, shown are the locations of the first control chamber 34 between the housing 20 and the control slide 12 and the second control chamber 36 between the housing 20 and the control slide 12 for receiving pressurized lubricant in the pump 10, relative to some of the pump parts. The first control chamber 34 is provided in the housing relative to a first side of the control slide 12, while the second control chamber 36 is provided on an opposite, second side of the control slide 12. The first control chamber 34 and the second control chamber 36 each has at least one port for receiving pressurized fluid. For example, the least one port may be communicated with the outlet 40 of the housing 20 for receiving the pressurized fluid under the positive discharge pressure. The pressurized fluid may be received from other sources of positive pressure as well, such as the engine oil gallery, piston squirters, etc., and diversion of the discharge pressure is not intended to be limiting.

The first control chamber 34 is controlled in a traditional manner using passive control, e.g., it is outlet pressure controlled or gallery pressure controlled by pressure feedback. That is, a positive pressure of force from the pressurized lubricant can be applied to the first control chamber 34, and thus applied to control slide 12, to force the slide 12 into its second slide position (or second pivotal direction) where eccentricity is decreased.

As further detailed below, the second control chamber 36 is controlled via the first control chamber 34, the control slide 12, and the thermally adjustable control valve 44. A first port 50 and a second port 52 are provided in the housing 20 and configured for selective fluid communication to form a control pressure channel extending between the first control chamber 34 and the second control chamber 36. Accordingly, the chambers 34, 36 can be connected by a control pressure channel as defined by ports 50 and 52, under certain circumstances.

FIGS. 5-8 show one embodiment of the thermally adjustable control valve 44 mounted in the cover 19. In an embodiment, the thermally adjustable control valve 44 is provided in a casing 38 that allows fluid communication or distribution of pressurized lubricant therethrough. The casing 38 may be formed separately from the housing 20 or cover 19 and attached thereto, or integrally formed within or therewith. The casing 38 may also be integrated or attached to the housing 20 or cover 19. The thermally adjustable control valve 44 is mounted in the casing 38 such that it can adjust or alter fluid communication between the first and second control chambers 34, 36. In accordance with an embodiment, the first port 50 and second port 52 are provided in casing 38. Thus, the thermally adjustable control valve 44 can be adjusted based on predetermined parameters to alter or change fluid communication through the control pressure channel formed by ports 50 and 52.

The thermally adjustable control valve 44 utilizes an on/off control based on at least a temperature of the lubricant to control the displacement or flow rate of the pump 10 (e.g., by directing the pressurized lubricant in the housing 20). The thermally adjustable control valve 44 is configured for movement between a first valve position and a second valve position based on a temperature of the lubricant. In an embodiment, the thermally adjustable control valve 44 is in the first valve position for a temperature that is below a predetermined temperature and in the second valve position for a temperature that is at or above the predetermined temperature.

In accordance with an embodiment, the thermally adjustable control valve 44 can react to a temperature determined by a thermally reactive device, for example. In an embodiment, the thermally adjustable control valve 44 can be mounted to casing 38 via a connector or plug 47 and a resilient device 46, such as a spring. The connector or plug 47 is provided at an end of the casing 38 and keeps or locks a first end of the resilient device 46 in its position within the casing 38. The spring 46 may be used for activating movement of the control valve 44 between the first valve position and the second valve position.

Figure 6:
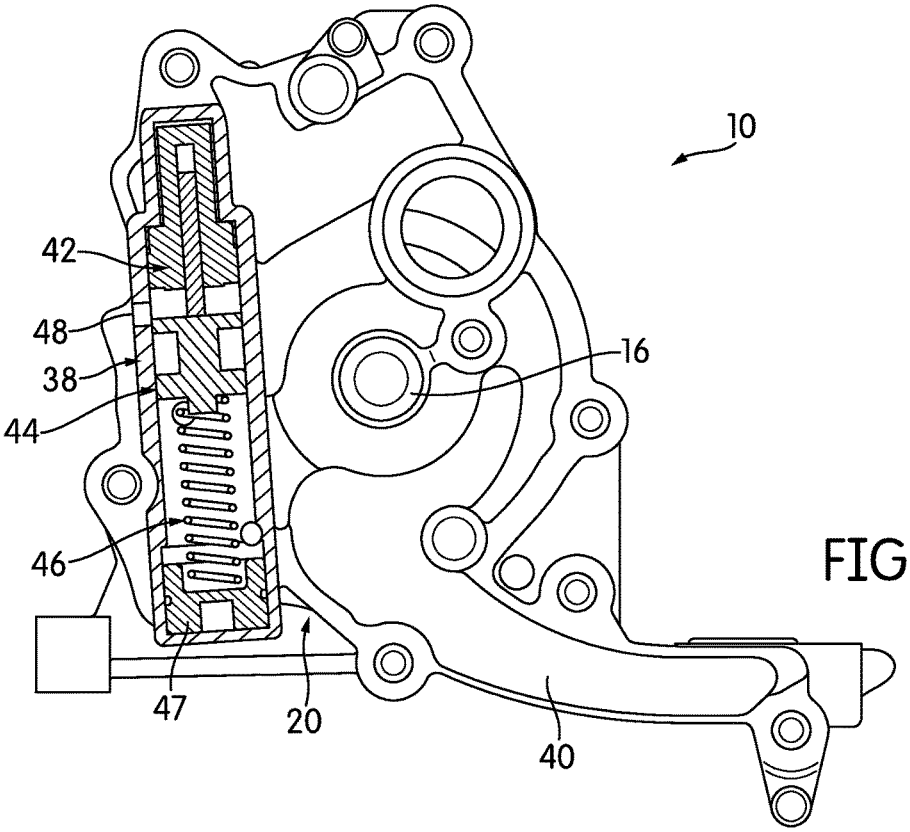
FIG. 6 is a sectional view of part of the pump taken along the line 6-6 of FIG. 5.
Figure 8:
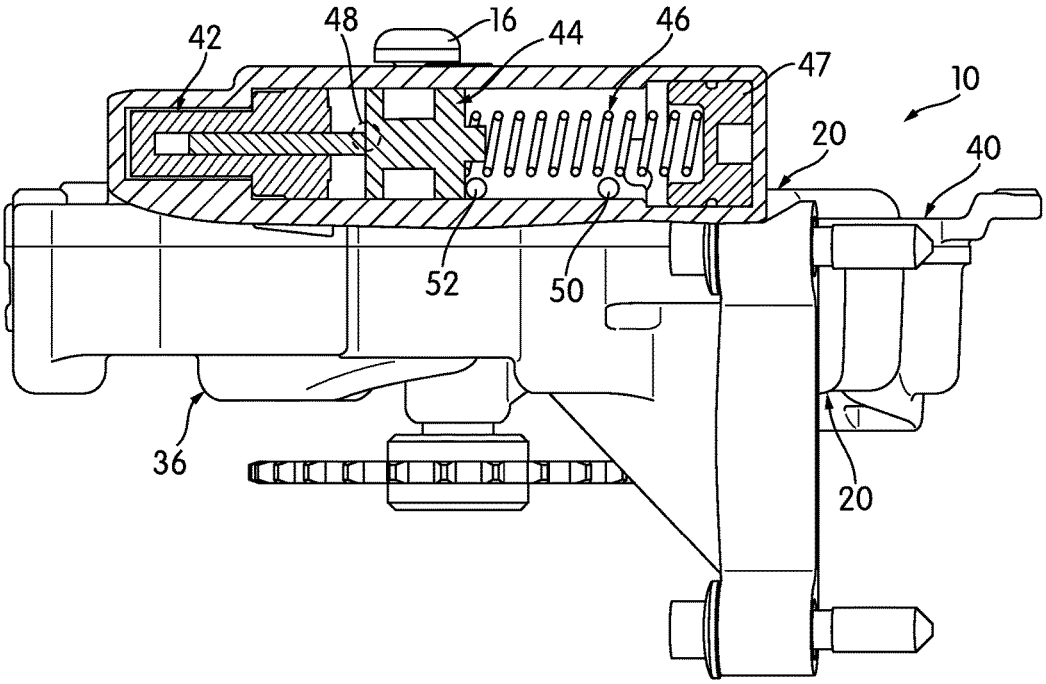
FIG. 8 is a sectional view of part of the pump taken along the line 8-8 of FIG. 7.
Figure 10:
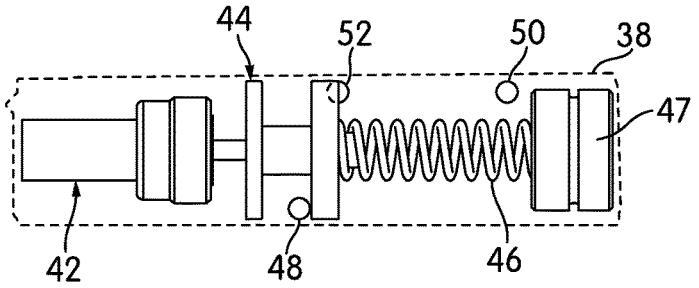
FIG. 10 shows a detailed view of a thermally adjustable control valve in a first valve position in a control pressure channel of the pump.
Figure 13:
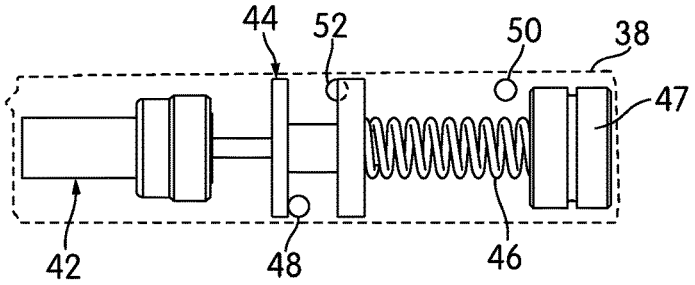
FIG. 13 shows a detailed view of a thermally adjustable control valve in a second valve position in a control pressure channel of the pump.

In an embodiment, the thermally reactive device used or associated with the thermally adjustable control valve 44 is a thermostat 42. The thermostat 42 can be connected to the control valve 44 (e.g., via a shaft) and secured within the casing 38, as shown in FIGS. 6 and 8, for example. The spring 46 has a function of keeping the control valve 44 in contact with the thermostat 42 under all conditions. As used herein, the thermostat 42 is a device that automatically controls a device, i.e., the control valve 44, when the temperature reaches or exceeds a certain point or predetermined temperature. The control valve 44 is moved by the thermostat 42 (e.g., via a shaft), for example, when a predetermined temperature is reached and/or exceeded. For example, in an embodiment, at warmer temperatures, e.g., at or above the predetermined temperature, the thermostat 42 may be configured to expand and in turn move the control valve 44 in one direction, e.g., against the spring 46 to compress the spring (as seen in FIG. 13, which is described later below). At colder temperatures, e.g., below the predetermined temperature, the thermostat 42 may be configured to retract and move the control valve 44 in another (opposite) direction, e.g., to move back such that the spring 46 decompresses and pushes the control valve 44, while still maintaining contact with the thermostat 42 (as seen in FIG. 10, which is also described later below).

In an embodiment, the thermostat 42 is configured for control over a temperature curve or range between approximately 40 degrees and approximately 80 degrees (Celsius). In an embodiment, the temperature curve and/or range may be adjusted to tune the pump 10 and its output according to parameters so desired by the user. For example, the temperature(s) at which the thermostat 42 is configured to react and/or move can be tuned geometrically so as to control the movement of the control valve 44, and, therefore, control the pump displacement.

As previously explained, the thermally adjustable control valve 44 is designed to reduce pump displacement at lower temperatures and reduce high pressure levels at low engine speeds that are not needed for engine performance based on a temperature of the lubricant (oil). Accordingly, the thermostat 42 and control valve 44 are used as a controller of the pump 10. To provide pressure adjustments in the housing 20 and chambers, the pump 10 includes a third port 48 that is configured for selective fluid communication with the second port 52 to form a vent channel between the second control chamber 36 and the thermally adjustable control valve 44. The position and/or movement of the control valve 44 can control the use and communication between the third port 48 and second port 52, i.e., the vent channel. The third port 48 is connected to/outlets to a surrounding environment of the pump, e.g., to the engine oil sump. As explained below, the third port 48 is configured to be selectively connected to the second control chamber 36, depending on a position of the control valve 44, to vent the second control chamber 36. In an embodiment, the third port 48 is provided in the casing 38 that contains the control valve 44 (e.g., see FIGS. 6 and 7). In an embodiment, the third port 48 is provided in the control valve 44. In an embodiment, the third port 48 is provided in the housing 20. In an embodiment, the third port 48 is provided in the cover 19.

In addition to the casing 38 for the control valve 44, the cover 19 and/or housing 20 also includes a vent port 54 provided therein (see, e.g., FIGS. 9 and 14). The vent port 54 is associated with, and/or connected to the second control chamber 36. The vent port 54 is configured for selective fluid communication with the second control chamber 36. Further, the use of the vent channel or the vent port 54 can be selectively controlled by the position of the control slide 12 within the housing 20 and/or relative to the cover 19. That is, based on the lubricant pressure levels (e.g., higher or lower) within the pump 10, either can be used for venting, when or during the venting of the second chamber (if at all). The vent port 54 may also be selectively connected to/outlet to the surrounding environment of the pump, e.g., to the engine oil sump.

In an embodiment, the vent port 54 is provided in the housing 20. In another embodiment, the vent port 54 is provided in the cover 19.

As detailed below, in an embodiment, at lower temperatures and higher speeds, the vent port 54 can be opened to vent the second control chamber 36, via movement of the control slide 12. In accordance with one embodiment, the control valve 44 is configured to pressurize the second control chamber 36 (e.g., at cold conditions), and when the slide moves further to a second slide position (e.g., to a minimum displacement position), vent port 54 opens up. In an embodiment, at higher temperatures with lower pressure, the second control chamber 36 can be vented via the vent channel (fluid communication through ports 48 and 52). When connected, the vent port 54 enables and connects the flow of lubricant through the vent channel from the second chamber 36 to the oil sump of the engine.

The control slide 12 movement may be either driven by the first control chamber 34 that adjusts the pump displacement to pressure level over engine speed (e.g., in hot conditions, the control valve 44 is positioned as shown in FIG. 10), or by pressure in first and second control chambers 34 and 36 (e.g., in cold conditions, the control valve 44 is positioned as shown in FIG. 13). The vent port 54 is controlled by the movement of the control slide 12.

The position of the control valve 44 is controlled based on the temperature of the lubricant within the pump 10.

The control slide 12 and control valve 44 are independently controlled. For example, the control valve 44 can be positioned in either its first valve position or its second valve position, or moved between such positions, no matter the position of the control slide 12 (e.g., in a first slide position, in a second slide position, in a maximum displacement position, in a minimum displacement position, or in a second slide position that is between or close to such maximum and/or minimum positions of the slide). As detailed below, the position of the control valve 44 (as controlled by the thermostat 42) adjusts the connection/fluid communication between the ports 50, 52 and vents 48, 54.

FIG. 10 shows the control valve 44 in a first valve position (in relation to casing 38) in a control pressure channel of the pump 10. In accordance with an embodiment, the first valve position of the thermally adjustable control valve 44 corresponds to lower fluid or lubricant temperatures (e.g., cold or colder temperatures of the lubricant). For example, in an embodiment, the thermally adjustable control valve 44 is provided in the first valve position at temperatures less than 60 degrees Celsius. In an embodiment using a thermostat 42, at lower temperatures (e.g., less than 60 degrees Celsius), the thermostat 42 is in a minimum length position.

As shown in FIG. 10, in its first valve position, the thermally adjustable control valve 44 is positioned such that the first port 50 and second port 52 may be fluidly communicating through its casing 38. Further, in this first position, the third port 48 is closed off by the control valve 44 such that there is no fluid communication between the third port 48 and at least second port 52 (i.e., the venting channel) and thus with the second control chamber 36. The control pressure of the first control chamber 34 may be guided through at least the thermally adjustable control valve 44, and in some cases the casing 38, via fluidly connected ports 50 and 52—depending on the position of the control slide 12.

Figure 12:
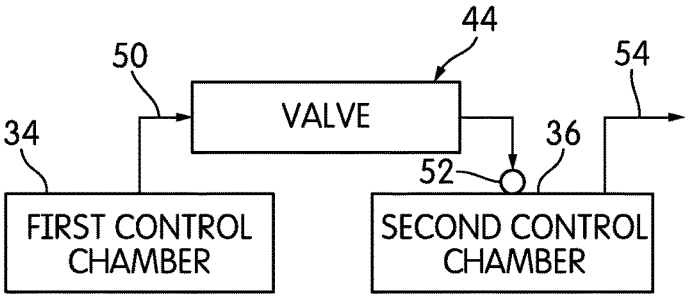
FIG. 12 is a schematic diagram illustrating fluid communication between first and second control chambers of the pump with the thermally adjustable control valve in the first valve position.

That is, pressurized lubricant may flow between the first control chamber 34 and the second control chamber 36, as schematically depicted in the diagram of FIG. 12, through the casing 38 via the position of the control valve 44 (depending on the position of the control slide 12). For example, when the control slide 12 is moved to a first slide position (e.g., maximum displacement) as shown in FIG. 14, and the control valve 44 is provided in its first valve position at colder temperatures as shown in FIG. 10, the second control chamber 36 can be pressurized by the first control chamber 34 via delivery of pressurized fluid from the first port 50 to the second port 52. The second chamber 36 is not, or is not substantially, vented because vent port 54 is blocked (by a tab portion on the slide 12), as shown in FIG. 14. Thus, in accordance with an embodiment, to reduce pump displacement at lower lubricant temperatures, the first control chamber 34 pressurizes the second control chamber 36.

In accordance with an embodiment, near or at minimum displacement (or in a second slide position), as shown in FIG. 11, for example, the control slide 12 is moved and positioned within the housing 20 to close fluid communication through the vent channel (i.e., through the third port 48 and the second port 52, because second port 52 is blocked) when the thermally adjustable control valve 44 is in the first valve position of FIG. 10. For example, the control slide 12 can be adjusted based on the pressurized fluid flowing within the chamber(s) 34, 36 and out of the outlet 40. When pressure is guided from the first control chamber 34 to the second control chamber 36 through the control valve 44 at lower temperatures, and the control slide 12 is in its minimum position, at least vent port 54 is opened by the control slide 12, as shown in FIG. 11 (as compared to FIG. 14, for example). The control slide 12 helps secure that the pump displacement pressure is not reduced by too much (by pressure from the second control chamber 36 acting on or actuating the control slide 12 to its maximum position), so that there is not the risk of too low of a pressure level at high engine speed(s).

Typically, at lower temperatures (e.g., lower than 60 degrees Celsius) and lower engine speeds (e.g., lower than 2500 rpm), the pump 10 runs at high pressure. By controlling the hydraulic pressure within the chambers 34 and 36 and output via the outlet 40 using the thermally adjustable control valve 44, i.e., by positioning the valve 44 in a first valve position and allowing fluid communication between the chambers 34, 36, the position of the control slide 12 can be controlled by the flow pressure, which, in turn, reduces the pump displacement at low temperatures. As such, the pressure level or displacement also goes down. This reduced pressure level also reduces the pump drive torque. Accordingly, the overall engine friction and engine CO2 emissions can be improved (e.g., lowered) when utilizing both the control valve 44 and control slide 12 as disclosed herein.

At lower temperatures of the lubricant and at maximum displacement, the second control chamber 36 can be pressurized by the first control chamber 34 up to the point when the control slide 12 moves from its maximum allowable displacement position. As the control slide 12 moves away from its maximum allowable displacement position (e.g., away from the position as shown in FIG. 14) (e.g., to a second or towards minimum displacement position), second port 52 may be closed and vent port 54 can be opened, such as shown in FIG. 11. As previously noted, in an embodiment, as or when the control slide 12 moves, vent port 54 can be selectively closed or covered (e.g., by tab portion on the slide 12) as the slide 12 continues to move between its other or second (minimum) displacement position and first (maximum) displacement position. Once second port 52 is closed, pressure feed to the second control chamber 36 from the first control chamber 34 is closed or substantially cut off, and the second control chamber 36 may be vented. Accordingly, in an embodiment, vent port 54 can be used to vent and communicate lubricant from the second control chamber 36 during such times. Vent port 54 vents the second control chamber 36 to substantially reduce and/or eliminate the pressure in that second control chamber 36, while at the same time the second port 52 is closed to avoid oil/lubricant flow into the second control chamber 36 (from the first control chamber 34), and, as a consequence, any lubricant leakage through the pump 10 that may reduce overall efficiency.

At lower temperatures and lower/minimum displacement position of the control slide 12, the control valve 44 can remain in its first position, such as shown in FIG. 10, even though the control slide 12 has moved to open up the vent 54.

At higher temperatures, however, the pressure level of the lubricant increases up to the control pressure. To control the pressure and pump displacement (e.g., reduce the pressure and displacement), the disclosed thermally adjustable control valve 44 may be activated.

Figure 15:
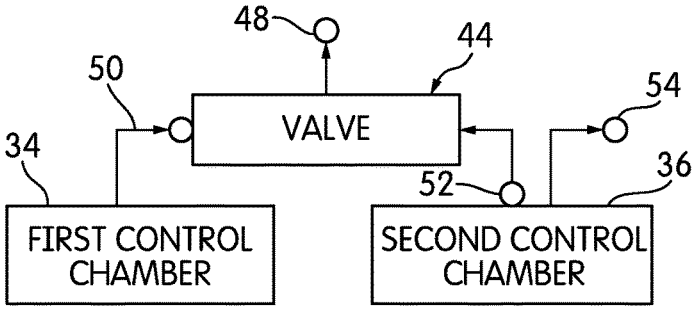
FIG. 15 is a schematic diagram illustrating portions for venting lubricant from the second control chamber of the pump with the thermally adjustable control valve in the second valve position.

As previously noted, to first control such pressure and displacement, the second control chamber 36 can be vented through the thermally adjustable control valve 44 and its casing 38, and/or the vent port 54. As previously noted, the control slide 12 may be moved to vent the second control chamber 36 and close off communication between the first and second control chambers 34, 36 based on the pressure of the flowing lubricant. Further still, the control valve 44 can be used to provide additional control of the pump 10 based on the temperature of the lubricant. Depending on the temperature and pressure of the lubricant, the second chamber 36 may be operated in a first venting mode or a second venting mode. For example, FIGS. 13 and 15 show the control valve 44 in a second valve position in a control pressure channel of the pump 10. In accordance with an embodiment, the second valve position of the thermally adjustable control valve 44 corresponds to higher lubricant temperatures. In an embodiment, the control valve 44 may also move to close off communication between the first port 50 and second port 52 and open and establish a vent at such higher lubricant temperatures. For example, in an embodiment, the thermally adjustable control valve 44 is provided in the second valve position at temperatures equal to and/or greater than 60 degrees Celsius. In an embodiment using a thermostat 42, at higher temperatures (e.g., at or higher than 60 degrees Celsius), the thermostat 42 is in a maximum length position, thus moving the control valve 44 to its second position (e.g., via shaft). Such features are shown in FIG. 13. As the control valve 44 is moved to the second position at these higher temperatures, the third port 48 associated with the casing 38 or valve 44 may be placed into fluid communication with the second port 52, to open the vent channel. Accordingly, in its second position, the thermally adjustable control valve 44 may be configured to control pressure in the second control chamber 36 via venting pressurized lubricant from the second control chamber 36 through the vent channel formed by connecting the third port 48 and the second port 52 (i.e., by communicating the second port 52 to the third port 48) or via vent port 54. Any lubricant that may discharge from the casing 38 via third port 48 can be directed to the engine oil sump.

The position of the control slide within the housing is further configured to aid in selectively controlling the venting of the pressurized lubricant through the vent channel or through the vent port 54 during venting of the second control chamber 36. Accordingly, the venting of the pressurized lubricant from the second control chamber 36 may change based on the position of the control slide 12 within the housing 20 and/or relative to the cover 19, between directing the pressurized lubricant through the vent channel (e.g., via placing second port 52 and third port 48 in fluid communication) and directing the pressurized lubricant through the vent port 54 provided in the second control chamber 36, which is depicted schematically in the diagram of FIG. 15. Thus it can be seen that the selective venting function of the second control chamber 36 may further be controlled by the control slide 12 positions (relative to the housing 20 and cover 19, based on flow pressure of the lubricant), in addition to the control valve 44 (which is based on temperature of the lubricant). The venting of the second control chamber also has the function of limiting the pump displacement when the control valve 44 is in its first position (since the outlet pressure is guided into the second control chamber 36 by the position of the thermostat 42 and control valve 44).

Specifically, in an embodiment, the control valve 44 is moved via the thermostat 42 and spring 46 to an extended position, as shown in FIG. 13, closing the fluid connection of the control pressure channel between first control chamber 34 and second control chamber 36 (i.e., closing off communication between ports 50 and 52). Accordingly, the thermostat 42 and control valve 44 are now in a maximum position. At the same time, the thermally adjustable control valve 44 has been moved and positioned such that the second port 52 and third port 48 can fluidly communicate through its casing 38, depending on the position of the control slide 12).

More specifically, in an embodiment, when the control slide 12 is positioned for higher displacement, or in a first venting mode, fluid or lubricant may be fed through the second port 52 and third port 48 of the casing 38. The control slide 12 may be positioned to close fluid communication through the control pressure channel when the control valve 44 is in the second valve position and the control slide 12 is positioned for higher displacement. As such, there may be no fluid communication between the first control chamber 34 and the second control chamber 36 and no pressurization of the second control chamber 36 via the control pressure channel.

As the control slide 12 is moved (e.g., counterclockwise) to lower displacement of the pump 10 (towards a second slide position), it may be moved to a second venting mode, opening up the vent port 54 so that vent port 54 is utilized for venting the second control chamber 36. Specifically, when the control slide 12 is moving (e.g., in reference to the Figures, when the control slide 12 is moving counterclockwise, or towards a position like that of FIG. 11) and reduces the pump displacement due to a pressure change, the control slide 12 can be moved towards the second slide position relative to the housing 20 and cover 19. In the second slide position, the control slide 12 closes off the second port 52, and, thus, the vent channel (formed between the second port 52 and the third port 48). At the same time, the vent port 54 may be opened to stop further displacement reduction of the pump. When the control slide 12 is in the second slide position, then, the pump 10 is only controlled by the first control chamber 34, outlet pressure, or gallery pressure. This is because the pump still needs to supply still higher pressure at higher engine speeds (e.g., greater than approximately 2500 rpm). Accordingly, at medium speed (e.g., approximately 2500 rpm) and a predefined or predetermined temperature where the thermally adjustable control valve 44 and/or the thermostat 42 is moving (e.g., 60 degrees Celsius), the control by the thermally adjustable control valve 44 and/or thermostat 42 is inactive when the pressure is low. Accordingly, the control valve 44 is adjusted via temperature and not engine speed.

However, to avoid too low of a pressure level at higher engine speeds, the influence of the thermally adjustable control valve 44 on the pump displacement reduction is limited. The maximum displacement reduction is defined by the position of the vent port 54 in the second control chamber 36, as shown in FIG. 14, for example, which is opened up for venting when the control slide 12 is moved further (e.g., counterclockwise) away from the minimum displacement position of FIG. 11 (into its maximum displacement position). Without vent port 54, the pump 10 would work at low temperatures only in a low pressure mode over the complete speed range of the engine. Thus, the vent port 54 allows for the pump 10 to provide a desired displacement at higher pressures and higher engine speeds, without being influenced by the thermally adjustable control valve 44. The vent port 54 can further be used at high engine speeds (and low lubricant temperatures) to maintain venting of the second control chamber 36 and help secure low pressure levels at the second control chamber 36 sot that the pump 10 is substantially or solely controlled by the first control chamber 34 at high pressure levels.

Thus, based on the position of the control slide 12 in the housing 20/relative to the cover 19, i.e., based off of the pressure and/or pressure change(s), and based on the position of the control valve 44 in its casing 38, i.e., based off of the temperature of the lubricant, the second control chamber 36 may be selectively vented either through the control valve 44 and casing 38 by the connection of second port 52 and the third port 48 (i.e., vent channel) or the vent port 54. Accordingly, the second control chamber 36 may be in a venting mode (e.g., either first venting mode or second venting mode), as opposed to being pressurized by the first control chamber 34, at higher lubricant temperatures. In either first venting mode or the second venting mode, the pump displacement is adjusted according to the engine's needs. Accordingly, it can be said that engine speed, pressure, and temperature are used to control the pump 10.

As such, this disclosure describes a thermally adjustable control valve 44 used along with a control slide 12 in a variable vane, multi-chamber pump 10. The pump 10 is controlled via temperature and pressure and adjusts pressure in at least the second chamber 36 based on the positions of the control valve 44 and control slide 12. In its first valve position (see FIGS. 7 and 8), the thermally adjustable control valve 44 is configured to control pressure in the second control chamber 36 via allowing fluid communication between the first port 50 and the second port 52 for delivery of pressurized lubricant through the control pressure channel into the second control chamber 36, thereby pressurizing the second control chamber. In its second valve position (see FIGS. 9 and 10), the thermally adjustable control valve 44 is configured to control pressure in the second control chamber via venting pressurized lubricant from the second control chamber 34 by communicating the second port 52 to the third port 48. Specifically, the venting of the pressurized lubricant from the second control chamber 36 may change based on the position of the control slide 12 within the housing 12, by directing the pressurized lubricant through the vent channel formed by third port 48 and second port 52 (e.g., in a first venting mode) or by directing the pressurized lubricant through the vent port 54 provided in the first control chamber 34 (e.g., in a second venting mode), if the second chamber 36 is vented.

In accordance with an embodiment, the selective venting of the pressurized lubricant from the second control chamber may be either through the vent channel or through the vent port, despite the position of the control slide.

Although not shown, seals can be provided in the housing 20 and/or cover 19. In the illustrated embodiment, two chambers are shown; however, in some embodiments more chambers could be used for finer control over pressure regulation. Similarly, any number of additional seals could be used.

Since the herein disclosed thermostat 42 is used as a controller for directing the lubricant in the pump 10, the use of an ECU (engine control unit) controller is not required (since the ECU function typically includes a similar function as the thermostat 42 in the overall pump control map). However, it should be understood that a controller like an ECU, may, in some embodiments, be associated and/or connected to the pump 10 and/or engine 32 to actively control one or more features of the pump as defined by a system map for the engine, e.g., based on engine operating speed, load on the engine, etc.

Also, the type of thermally reactive device used to control the valve 44 itself is not intended to be limited to a thermostat, like thermostat 42, in this disclosure. Rather, an alternative and/or additional mechanical device, such as a thermally reactive spring, can be used to control the control valve 44.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A variable displacement vane pump for dispensing lubricant to a system, comprising:

a housing;

an inlet for inputting lubricant from a source into the housing;

an outlet for delivering pressurized lubricant to the system from the housing;

a control slide displaceable within the housing between a first slide position and a second slide position to adjust displacement of the pump through the outlet;

a resilient structure biasing the control slide in the first slide position;

a rotor with at least one vane mounted in the housing and configured for rotation within and relative to the control slide, the at least one vane configured for engagement with an inside surface of the control slide during rotation thereof;

a first control chamber between the housing and the control slide and a second control chamber between the housing and the control slide for receiving pressurized lubricant;

a thermally adjustable control valve provided in a casing, the thermally adjustable control valve adapted for movement between a first valve position and a second valve position within the casing based on a temperature of the lubricant, the thermally adjustable control valve being in the first valve position for a temperature that is below a predetermined temperature and in the second valve position for a temperature that is at or above the predetermined temperature;

a first port provided in the casing that is connected to the first control chamber and a second port provided in the casing that is connected to the second control chamber, the first and second ports configured for selective fluid communication to form a control pressure path from the first port to the second port through the casing that extends between the first control chamber and the second control chamber;

a third port associated with the valve configured for selective fluid communication with the second port based on the position of the valve to form a vent path from the second port to the third port; and a vent port provided in the housing and configured for selective fluid communication with the second control chamber;

wherein, in its first valve position, the thermally adjustable control valve is adapted to control pressure in the second control chamber via fluid communication of the first port and the second port for delivery of pressurized lubricant from the first control chamber through the control pressure path of the casing and into the second control chamber, thereby pressurizing the second control chamber;

wherein, in its second valve position, the thermally adjustable control valve is adapted to control pressure in the second control chamber (a) via venting pressurized lubricant from the second control chamber through the vent path by communicating the second port to the third port or (b) via venting pressurized lubricant from the second control chamber to the vent port.

2. The pump according to claim 1, wherein the venting of the pressurized lubricant through the vent path or through the vent port is independent of the position of the control slide.

3. The pump according to claim 1, wherein the control slide is configured to be positioned to close fluid communication through the vent path when the thermally adjustable control valve is in the first valve position.

4. The pump according to claim 1, wherein the control slide is configured to be positioned to close fluid communication through the control pressure path when the control valve is in the second valve position.

5. The pump according to claim 1, wherein the housing includes a cover, and wherein the vent port is provided in the cover of the housing.

6. The pump according to claim 1, further comprising a thermostat associated with the thermally adjustable control valve, and wherein the thermostat is configured to be used to adjust the thermally adjustable control valve between its first and second valve positions.

7. The pump according to claim 1, and wherein the third port is provided in the casing, and wherein the vent path extends from the second port to the third port through the casing.

8. The pump according to claim 1, wherein the resilient structure is a spring.

9. The pump according to claim 1, wherein the control slide is pivotally mounted and configured for pivotal displacement within the housing between the first slide position and the second slide position.

10. The pump according to claim 1, wherein the predetermined temperature is approximately 60 degrees Celsius.

11. The pump according to claim 1, wherein the system is an engine.

12. A system comprising:

an engine;

a lubricant source containing lubricant;

a variable displacement vane pump connected to the lubricant source for dispensing lubricant to the engine, the pump comprising:

a housing;

an inlet for inputting lubricant from a source into the housing;

an outlet for delivering pressurized lubricant to the system from the housing;

a control slide displaceable within the housing between a first slide position and a second slide position to adjust displacement of the pump through the outlet;

a resilient structure biasing the control slide in the first slide position;

a rotor with at least one vane mounted in the housing and configured for rotation within and relative to the control slide, the at least one vane configured for engagement with an inside surface of the control slide during rotation thereof;

a first control chamber between the housing and the control slide and a second control chamber between the housing and the control slide for receiving pressurized lubricant;

a thermally adjustable control valve provided in a casing, the thermally adjustable control valve adapted for movement between a first valve position and a second valve position within the casing based on a temperature of the lubricant, the thermally adjustable control valve being in the first valve position for a temperature that is below a predetermined temperature and in the second valve position for a temperature that is at or above the predetermined temperature;

a first port provided in the casing that is connected to the first control chamber and a second port provided in the casing that is connected to the second control chamber, the first and second ports configured for selective fluid communication to form a control pressure path from the first port to the second port through the casing that extends between the first control chamber and the second control chamber;

a third port associated with the valve configured for selective fluid communication with the second port based on the position of the valve to form a vent path from the second port to the third port; and a vent port provided in the housing and configured for selective fluid communication with the second control chamber;

wherein, in its first valve position, the thermally adjustable control valve in the variable displacement vane pump is adapted to control pressure in the second control chamber via fluid communication of the first port and the second port for delivery of pressurized lubricant from the first control chamber through the control pressure path of the casing and into the second control chamber, thereby pressurizing the second control chamber;

wherein, in its second valve position, the thermally adjustable control valve in the variable displacement vane pump is adapted to control pressure in the second control chamber (a) via venting pressurized lubricant from the second control chamber through the vent path by communicating the second port to the third port or (b) via venting pressurized lubricant from the second control chamber to the vent port.

13. The system according to claim 12, wherein the venting of the pressurized lubricant through the vent path or through the vent port is independent of the position of the control slide.

14. The system according to claim 12, wherein the control slide is configured to be positioned to close fluid communication through the vent path when the thermally adjustable control valve is in the first valve position.

15. The system according to claim 12, wherein the control slide is configured to be positioned to close fluid communication through the control pressure path when the control valve is in the second valve position.

16. The system according to claim 12, wherein the housing includes a cover, and wherein the vent port is provided in the cover of the housing.

17. The system according to claim 12, further comprising a thermostat associated with the thermally adjustable control valve, and wherein the thermostat is configured to be used to adjust the thermally adjustable control valve between its first and second valve positions.

18. The system according to claim 12, and wherein the third port is provided in the casing, and wherein the vent path extends from the second port to the third port through the casing.

19. The system according to claim 12, wherein the resilient structure is a spring.

20. The system according to claim 12, wherein the control slide is pivotally mounted and configured for pivotal displacement within the housing between the first slide position and the second slide position.

21. The system according to claim 12, wherein the predetermined temperature is approximately 60 degrees Celsius.

22. The system according to claim 12, wherein the system is an engine.

23. The pump according to claim 1, wherein the position of the control slide within the housing is further configured to aid in selectively controlling the venting of the pressurized lubricant through the vent path or through the vent port during venting of the second control chamber.

24. The system according to claim 12, wherein the position of the control slide within the housing is further configured to aid in selectively controlling the venting of the pressurized lubricant through the vent path or through the vent port during venting of the second control chamber.

* * * * *